US005169115A

United States Patent [19]

Chung hsiang

[11] Patent Number: 5,169,115

[45] Date of Patent: Dec. 8, 1992

[54] ADHESIVE- AND FASTENER-FREE FOOTING PAD

[76] Inventor: Lin Chung hsiang, 5F-23, 70, Fu-Shing Road, Taoyuan, Taiwan

[21] Appl. No.: 755,849

[22] Filed: Sep. 6, 1991

[51] Int. Cl.[5] ..... F16M 13/00

[52] U.S. Cl. ..... 248/677; 16/30; 24/453; 248/188.8; 411/509

[58] Field of Search ..... 248/188.9, 188.91, 188.8, 248/677; 16/42 T, 32, 30, 39; 411/41, 509; 24/453, 297

[56] References Cited

U.S. PATENT DOCUMENTS

| | | | |
|---|---|---|---|
| 2,849,201 | 8/1958 | Schelgunov | 248/188.9 |
| 2,886,918 | 5/1959 | Bayley et al. | 248/188.9 |
| 2,906,482 | 9/1959 | Flint | 248/18.8 |
| 3,401,908 | 9/1968 | Rapata | 248/188.8 |
| 4,780,037 | 10/1988 | Payne | 24/297 X |
| 5,007,607 | 4/1991 | Kim | 248/188.9 |

FOREIGN PATENT DOCUMENTS

| | | | |
|---|---|---|---|
| 260779 | 9/1947 | Switzerland | 248/188.9 |

OTHER PUBLICATIONS

IBM Technical Disclosure Bulletin, vol. 15 No. 12 May 1973.

*Primary Examiner*—David L. Talbott
*Attorney, Agent, or Firm*—Bacon & Thomas

[57] ABSTRACT

Disclosed herein is an adhesive- and fastener-free footing pad including a pad seat located in the bottom of a housing, a protrudent ring corresponding to the circumference of the pad seat forward on the housing and a footing pad. The pad seat has a circular block, the footing pad has a plurality of claw elements each with a reserve hook so that when the footing pad is installed, the reserves hooks are retained by the circular block, and the footing pad is positioned by the protrudent ring to secure the footing pad to the pad seat firmly. Such a design can prevent displacement of the footing pad after its installation, and can withstand a considerable thrust.

4 Claims, 4 Drawing Sheets

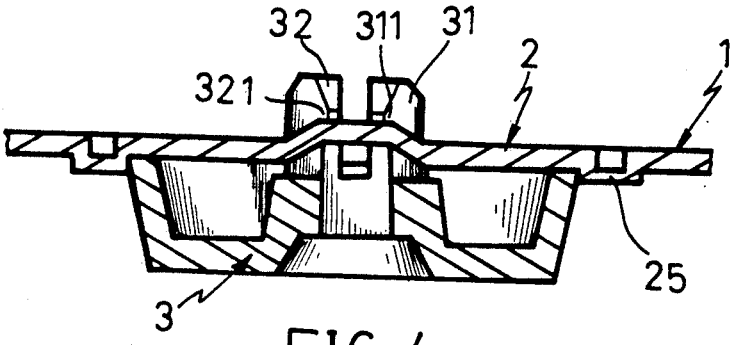
FIG.4
FIG.5
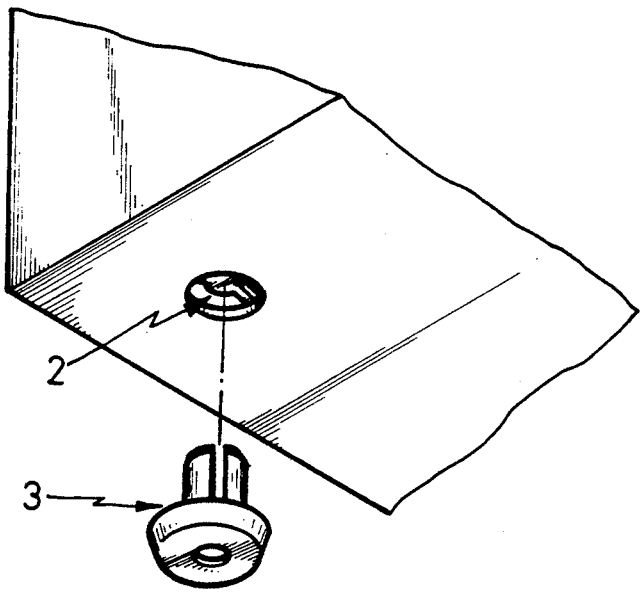
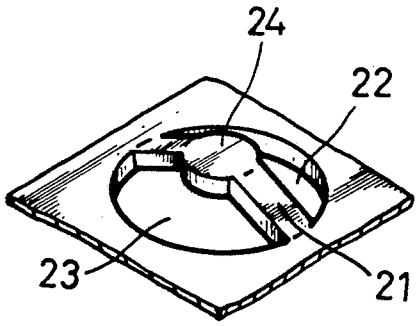
FIG.5-1

ADHESIVE- AND FASTENER-FREE FOOTING PAD

BACKGROUND OF THE INVENTION

Generally, footing pads are installed at the bottom of an electric appliance to facilitate placing of the electric appliance on a table. Normally, such footing pads are made of rubber or plastic material to raise and to protect the electric appliance. They are conventionally fixed to the electric appliance by fasteners or adhesive. Production and assembly of such footing pads are labor and time consuming. In view of such defects, the inventor has created an adhesive- and fastener-free footing pad.

The adhesive- and fastener-free footing pad according to the present invention has the following features:

(1) A protrudent ring corresponding to the circumference of pad seat is formed on the housing to position the footing pad and prevent it from lateral movement after installation.

(2) Each claw element in the footing pad has a reverse hook to be retained by a circular block in the seat pad in order to prevent from falling down of the footing pad.

(3) The design of the protrudent ring and the reserve hooks provides a tight connection between the footing pad and the pad seat without use of any fastener or adhesive, and such tight connection can withstand a considerable thrust.

(4) It is a simple structure which is easy to assembly but provides a strong connection to all kinds of electric appliances.

(5) It is suitable for housing made from a metal sheet of 0.8-1.6 mm thick, such as a housing for a computer. The height of pad seat can be adjusted to fit the reverse hooks for use on housings of different thickness.

SUMMARY OF THE INVENTION

The present invention provides an adhesive- and fastener-free footing pad including a pad seat located in the bottom of a housing, a protrudent ring corresponding to the circumference of the pad seat formed on the housing and a footing pad. The pad seat has a circular block, the footing pad has a plurality of claw elements each with a reserve hook so that when the footing pad is installed, the reserves hooks are retained by the circular block, and the footing pad is positioned by the protrudent ring to secure the footing pad to the pad seat firmly. Such a design can prevent from displacement of the footing pad after its installation, and can withstand a considerable thrust.

BRIEF DESCRIPTION OF THE DRAWINGS

FIG. 1—1 illustrates an embodiment of the pad seat according to the present invention.

FIG. 4 is a sectional view of the footing pad after fixing of the pad seat according to the present invention.

FIG. 5 is a perspective view of another embodiment of the bottom of a housing with a pad seat according to the present invention.

FIG. 5-1 illustrates another embodiment of the pad seat according to the present invention.

DETAILED DESCRIPTION OF THE PREFERRED EMBODIMENT

Figure 1:
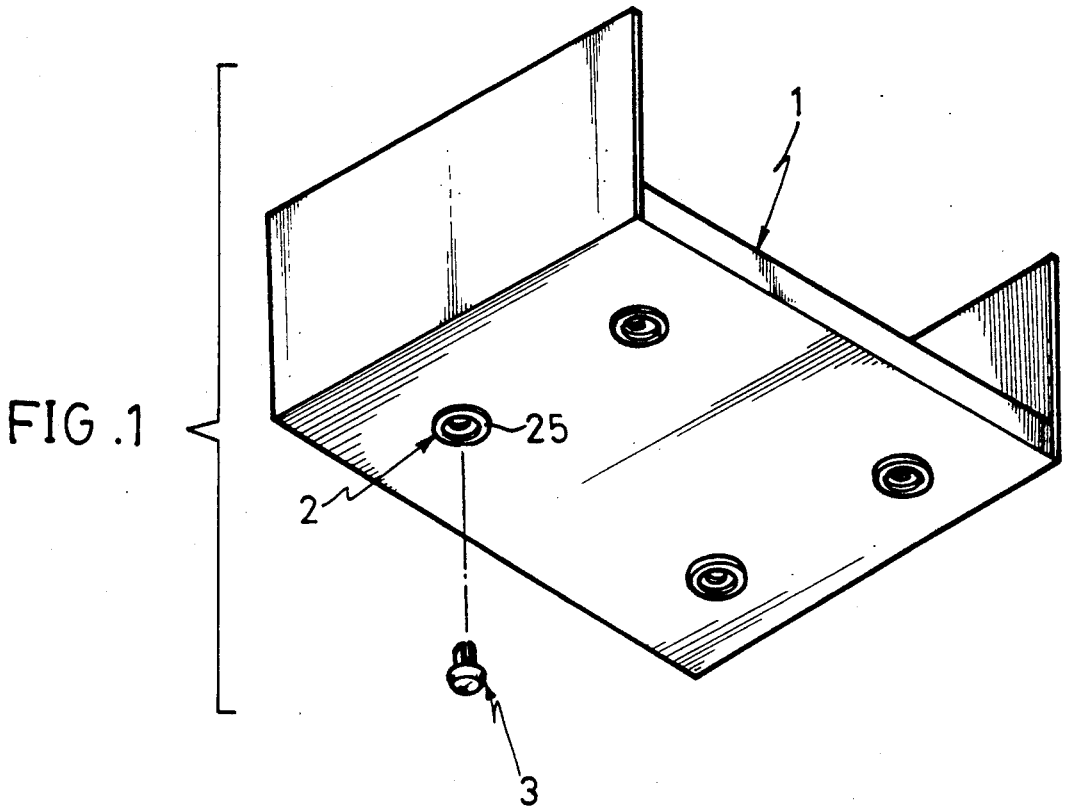
FIG. 1 is a perspective view of the bottom of a housing with a pad seat according to the present invention.
Figure 1:
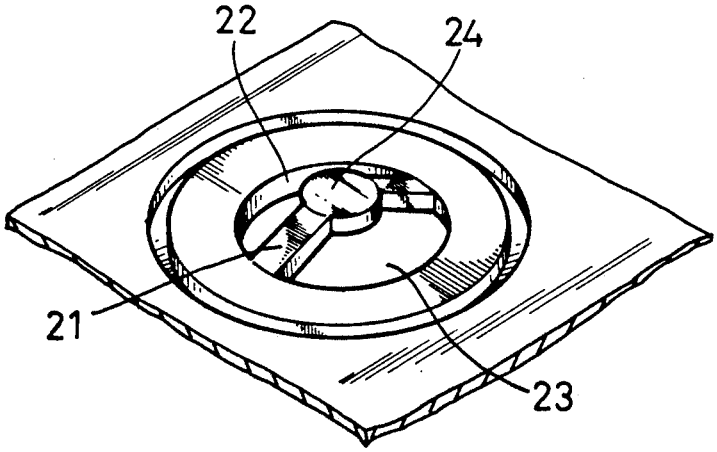

Please refer to FIGS. 1 and 1—1, the present invention include a structure of a pad seat (2) located at appropriate position at the bottom of any housing (1). The pad seat (2) is a recessive structure with a partition board (21) and two slots (22 and 23). A circular block (24) is designed in the center of the partition board (21), a protrudent ring (25) corresponding to the circumference of the pad seat (2) is formed on the housing (1) so that the pad seat (2) and the protrudent ring (25) appear as an annular concave seat.

Figure 2:
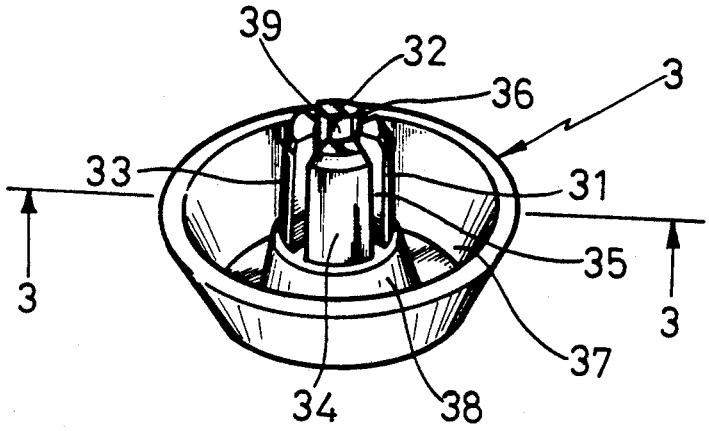
FIG. 2 is a perspective view of a footing pad according to the present invention.
Figure 3:
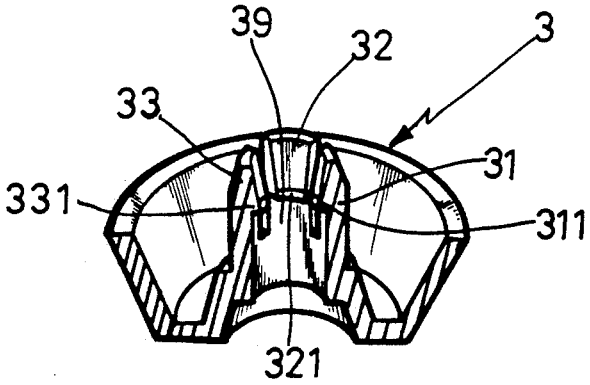
FIG. 3 is a sectional view of the footing pad taken along the line 3—3 in FIG. 2.
Figure 6:
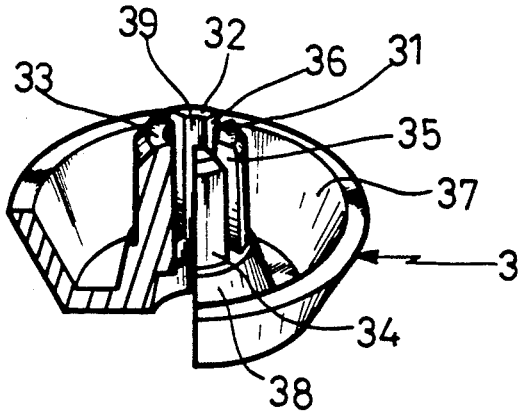
FIG. 6 is a sectional view of the footing pad according to another embodiment of the present invention.

Please refer to FIGS. 2 and 3, the footing pad (3) according to the present invention has four claw elements (31, 32, 33 and 34) in the center. There is a seam (35 or 36) between any two adjacent claw elements (31, 32, 33 and 34) so that a cross opening is formed. An annular slot (37) is designed surrounding the claw elements (31, 32, 33 and 34), and a support (38) is formed in the center of the footing pad (3). The support (38) and the claw elements (31, 32, 33 and 34) are formed as an integrated part of the footing pad (3). A cavity (39) is formed in the middle of a space surrounded by the four claw elements (31, 32, 33 and 34). Each of the claw elements (31, 32, 33 or 34) has a reverse hook (311, 321, 331, or 341) on the side facing the cavity (39). Each reserve hook (311, 321, 331 or 341) is formed by a projection from a claw element (31, 32, 33 or 34) extending downwards and has its shape diminished gradually. The reserve hook (341) on the claw element (34) is not shown in the drawings.

As shown in FIGS. 1, 2, and 4, after placing the footing pad (3) to the pad seat (2) on the housing (1), the claw elements (31, 32, 33 and 34) are inserted into the slots (22 and 23), the circular block (34) is matched with the cavity (39) so that the reserve hooks (311, 321, 331 and 341) are retained by the circular block (24) of the pad seat (2), and hence the footing pad (2) is retained, and prevented from downward displacement. Moreover, since the protrudent ring (25) of the pad seat (2) forms an annular seat, the circumference of the footing pad (3) is positioned by the protrudent ring (25), and then the footing pad (3) is prevented from lateral movement. With such a design, the footing pad (3) is tightly fixed to the pad seat (2) without any fastener, and such a fixing can withstand a considerable thrust.

As shown in FIG. 4, the present invention is suitable for metal housing (0.8-1.6 mm thick) for computer. Only the height of the pad seat (2) has to be adjusted to fit the reserve hooks (311, 321, 331 and 341) of the footing pad for use on housing of different thickness.

FIGS. 5, 5-1, 6 and 7 illustrates another embodiment of pad seat (2) and footing pad (3) according to the present invention. The pad seat (2) also has a partition board (21) and two slots (22 and 23) with a circular block (24) in the center, but the protrudent ring (25) corresponding to the circumference of the pad seat (2) is not formed on the housing. The footing pad (3) also has four claw elements (31, 32, 33 and 34) and the corresponding seams (35 and 36), annular slot (37), support

Figure 7:
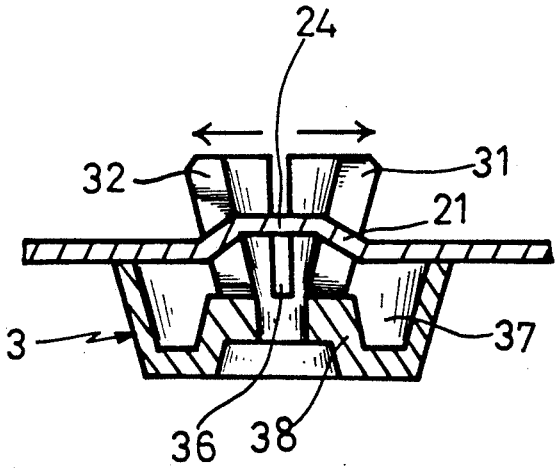
FIG. 7 is a sectional view of the footing pad after fixing to the pad seat according to another embodiment of the present invention.

(38) and cavity (39), but none of the claw elements (31, 32, 33 and 34) is formed with reserve hook (311, 321, 331 or 341). With such a design, as shown in FIG. 7, the claw elements (31 and 32) are inserted into the slot (22), the claw elements (33 and 34) are inserted into the slot (23), the circular block (24) is matched with the cavity (39) of the footing pad (3), and the claw elements (31, 32, 33 and 34) are extending outwards in the slots (22 and 23) to retain the footing pads (3) in place.

The slots (22 and 23) are tilted so that the claw elements (31, 32, 33 and 34) are inserted into the slots (22 and 23) on a slant and then compressed by the circular block (24) to extend outwards, and hence the footing pad is secured.

I claim:

1. An adhesive and fastener-free footing pad assembly for a bottom portion of a housing comprising:

a housing having a bottom portion formed with at least one aperture therein;

a pad seat located within each of said at least one aperture, said pad seat including a circular block located substantially in the center of the aperture and at least two partition boards extending from said circular block toward said bottom portion, said circular block being located in a plane which is substantially parallel to but offset from a plane defined by said bottom portion, said partition boards being angled between said bottom portion and said circular block so as to define a plurality of slots about said circular block; and a substantially bowl-shaped footing pad having a support integrally formed at the center thereof with an annular slot thereabout and a plurality of claw elements formed integral with said support, said plurality of claw elements further being circumferentially spaced on said support defining a seam between adjacent claw elements and a cavity in the center thereof, said footing pad being adapted to be attached to said pad seat with said claw elements extending through said slots so that said circular block is received within said cavity and said claw elements engage said circular block to secure said footing pad to said pad seat.

2. An adhesive and fastener-free footing pad assembly as claimed in claim 1, wherein each of said claw elements further include a hook portion projecting into said cavity, said hook portion on each of said claw elements being adapted to engage said circular block to secure said footing pad to said pad seat.

3. An adhesive and fastener-free footing pad assembly as claimed in claim 2, further including a protrudent ring formed on the bottom of said housing, said protrudent ring having an inner diameter slightly greater than the outer diameter of said footing pad so as to extend about said footing pad and prevent lateral shifting thereof when said footing pad is inserted within said pad seat.

4. An adhesive and fastener-free footing pad assembly as claimed in claim 1, wherein said claw elements diverge outwardly away from said support and are biased outwardly by said circular block to secure said footing pad within said pad seat.

* * * * *